US009408766B2

(12) United States Patent
Capilla

(10) Patent No.: US 9,408,766 B2
(45) Date of Patent: Aug. 9, 2016

(54) PATIENT TRANSPORT VEHICLE

(71) Applicant: Jorge Horacio Capilla, Olavarria (AR)

(72) Inventor: Jorge Horacio Capilla, Olavarria (AR)

( * ) Notice: Subject to any disclaimer, the term of this patent is extended or adjusted under 35 U.S.C. 154(b) by 464 days.

(21) Appl. No.: 14/068,392

(22) Filed: Oct. 31, 2013

(65) Prior Publication Data

US 2015/0113727 A1 Apr. 30, 2015

(51) Int. Cl.
*A61G 7/10* (2006.01)
*A61G 1/02* (2006.01)

(52) U.S. Cl.
CPC ..... *A61G 7/1017* (2013.01); *A61G 7/1019* (2013.01); *A61G 7/1046* (2013.01); *A61G 7/1055* (2013.01); *A61G 7/1061* (2013.01); *A61G 1/0212* (2013.01); *A61G 7/1057* (2013.01); *A61G 2203/12* (2013.01)

(58) Field of Classification Search
CPC . A61G 7/1017; A61G 7/1019; A61G 7/1046; A61G 7/1055; A61G 7/1057; A61G 7/1061; A61G 7/10; A61G 7/1013; A61G 1/0212; A61G 2203/12
See application file for complete search history.

(56) References Cited

U.S. PATENT DOCUMENTS

| | | | | |
|---|---|---|---|---|
| 2,666,930 | A * | 1/1954 | Lenahan | A61G 7/053 5/86.1 |
| 7,373,704 | B1 * | 5/2008 | Blacklock | A61G 7/1015 27/28 |
| 8,060,958 | B1 * | 11/2011 | Hough | A61G 7/1017 5/83.1 |
| 2007/0000049 | A1 * | 1/2007 | White | A61G 7/1015 5/84.1 |
| 2010/0000015 | A1 * | 1/2010 | Althaus | A61G 7/1015 5/83.1 |
| 2010/0115695 | A1 * | 5/2010 | White | A61G 7/1015 5/81.1 R |
| 2014/0137323 | A1 * | 5/2014 | Fernie | A61G 7/1019 5/83.1 |

* cited by examiner

*Primary Examiner* — David E Sosnowski
(74) *Attorney, Agent, or Firm* — Donald J. Ranft; Kristen A. Mogavero; Collen IP

(57) ABSTRACT

A patient transport vehicle including lower chassis mounted on wheels in the bed supported by a column mounted on the lower chassis. A lift cart is supported by towers mounted on the lower chassis with a section configured to rise out from the top of each tower. A lift cart actuator is utilized to raise and lower the inner section of each tower thereby raising and lowering the lift cart. A swing mechanism is mounted on the lift cart with a swing actuator to control its movement. Two or more hangers are attached swing mechanism and utilized to support a patient wrapped in a patient support pad.

11 Claims, 7 Drawing Sheets

PATIENT TRANSPORT VEHICLE

BACKGROUND

As it is known, currently most patients hospitalized in Hospitals and Health Centers, must be carried internally therein in order to access different areas of diagnosis and treatment, including mostly the surgical area.

To that end, there is the usual routine wherein the patient is placed in the room at least by two medical workers or specialized stretcher-bearer staff who, firstly proceed to place the patient support pad under the body of the patient. The patient support pad is a textile piece of plastic material, resistant and washable including grip handles in correspondence with its perimeter edge.

Once the patient is prepared, they proceed to bring the stretcher close, placing it adjacent to the bed and to execute the maneuvers of moving the patient until the patient is placed on the transfer stretcher. To do so, they follow very strict universal rules that require the presence of a medical worker or stretcher-bearer on one side of the bed, another at the end and the third at the bedhead, in many cases a fourth person is included, located at the side of the stretcher, opposite to the first one. Then the medical workers located on the sides bend forward, holding the handles of the stretcher or patient support pad, while the other two hold the head and feet of the patient.

Then somebody orders the transfer so that, jointly and in unison, the patient is lifted, laterally moved and placed on the attached stretcher, which still with the best willingness and experience results an abrupt and untimely maneuver due to the limitation of the human effort upon the weight and location of the patient to be moved.

Once the patient is placed on said stretcher, movement thereof takes place with a stretcher-bearer at the front and another at the end, which is moved from the room towards the halls and elevators until it reaches the area where the patient is subjected to a diagnosis or treatment (rays, tomography, orthopedics, etc.) or the surgery area where said maneuvers are made again to place the patient on the corresponding operating table.

Finally, once each treatment of the patient has finished the patient must return to their bed, therefore the same moving and transfer service as described above is required.

It can be affirmed that, until today no apparatus, devices or equipment conceived for replacing in the same manner and idiosyncrasy the maneuvers at unison made by stretcher-bearers and medical workers to move inpatients are known. Only some boards are known that have perimeter handles or coach-stretchers that displace to the side a rigid conveyor belt of considerable thickness which is introduced through a crank between the bed and the patient and that after inverting the sense literally "drags" the patient towards the stretcher without lifting him and this mechanical device cannot copy at all the softness of the cradle made by the patient support pad, however they do not eliminate most of the synchronization tasks or efforts needed to move the patient.

Advantages

According to the present invention, once the patient support pad is placed under the patient, there must proceed to his transfer to the invented vehicle, which requires no effort whatsoever. Then the same stretcher-bearer via the remote control activates the electro mechanical devices so that, through the lift cart and pivotal arms makes the smooth synchronic movement maneuvers explained above.

In order to take the objective and function superficially stated into practice, the invented patient transport vehicle is constituted on a lower chassis mounted over wheels of easy displacement, wherefrom a stretcher is projected that comprises a pair of vertical towers whereby a special and novel lift cart displaces, having two parallel brackets projected towards a same side.

From the free ends of the mentioned brackets the hereinafter referred to as swing is defined, constituted by a mounted longitudinal rigid pipe, on rotatory condition on corresponding bushings located on the free ends of said brackets, of which end incurved arms are supportive, and a central arm, equidistant therefrom, all of which constitute the arm of the swing, supportive to the abovementioned rotatory longitudinal rigid pipe.

Likewise, said incurved arms of the swing support, by its respective free ends a longitudinal rigid bar wherefrom a plurality of hangers hang with the form of a semi-circumferential arc, distinguished because, on their external free ends they have attachment means for the removable collocation of a plastic material provided to hold and contain the prostrated patient, which may be called a stretcher, a bed pad or a patient support pad, which particularly in this invention extends from head to toes.

One of the mentioned incurved arms is associated to a corresponding electro mechanic actuator integrated to the command and actuation circuit of the set. In this manner from the aforementioned control remote, the stretcher-bearer shall be able to drive the displacements of lateral transfer on both directions.

The mentioned lift cart, mounted in telescopic sliding condition in respect of the referred vertical towers, is actuated by an electric actuator through which the up and down displacements of the swing are produced, while one of the referred incurved arms is associated to a second actuator through which the regulated lateral displacements are produced.

In this manner from the aforementioned control remote, the stretcher-bearer shall be able to drive the up and down displacements, combined with the lateral transfer displacements on both directions.

No patient transport vehicle bed or equivalent equipment currently known proposes, or even suggests, the constructive solution that arises from what is indicated in the preceding paragraphs, which is why it is a proposal that, besides being novel has a clear inventive activity.

SUMMARY

The main object of this invention is an patient transport vehicle for transporting and moving inpatients, conceived especially to take the hospitalized patient, generally in supine position, lift the patient and place the patient on a built-in stretcher, to move the patient through hospital, with the ability to transfer the patient to a work table, of the type used at diagnostic services, or to an operating table, or its equivalent, without demand of effort of the medical support person or the patient who adopts an absolutely passive attitude upon the team performing the maneuvers.

More precisely, this patient transport vehicle is a patient vehicle that can be moved as if it were a hospital stretcher, with the distinctive feature that it includes a novel system of electro mechanic mechanism designed to move the patient who is in a laying down position, lift the patient and place the patient on a transfer stretcher, without any effort. This transfer is accomplished using electric actuators which are controlled with a remote control.

The electro mechanical mechanism controls an integrated system of movements starting from any patient position. The patient transport vehicle provides lifting and lowering movements on the vertical level, and lateral movements on the horizontal level. This enables transferring patients in between stretchers and its equivalents, on an accurate, sequential, silent, safe, imperceptible and therefore extremely comfortable manner for the patient, constituting a useful easily handled patient transport vehicle for use in any health center.

It is especially highlighted that with the invented vehicle, the need for anyone lifting the hospitalized patient with effort is eliminated. Without this patient transport vehicle, people such as medical facility or ambulance workers, are required to make anti ergonomic body movements that affect their own spine and waist system which often causes usual pathologies and illnesses for these people in wards at hospitals and health centers.

With the invented vehicle, the medical support person only places the patient support pad under the patient and introduces the clasps in the existing attachments being in this way connected to the vehicle, and proceeds to command the lifting and transfer movements using a remote control, acting as spectator and supervisor of the maneuvers.

It is an invention that defines a new combination of means and systems conceived to achieve a superior result, thus being unpredictable and surprising for an expert in the field. In consequence, besides being new, its structural and functional conception shows a clear inventive activity, thus, meeting the legal requirements to be considered a patent of invention.

BRIEF DESCRIPTION OF DRAWINGS

In order to fulfill the superficially aforementioned advantages, to which users and people with knowledge in the art shall be able to add many more, and in order to facilitate understanding of the constructive, constitutive and functional characteristics of the invented patient transport vehicle, the example of a preferred embodiment will be described which is schematically illustrated and without a determined scale, in the accompanying pages, said example shall not be considered as limitative or exclusive of the scope of protection of the present patent of invention, it simply intends to merely explain and illustrate the basic conception on which it is based. Clarification is made that, in all figures, same reference numerals and letters relate to the same or equivalent parts or elements that constitute the set, according to the example chosen for the present explanation of the patient transport vehicle.

PARTS LIST

Figure 1:
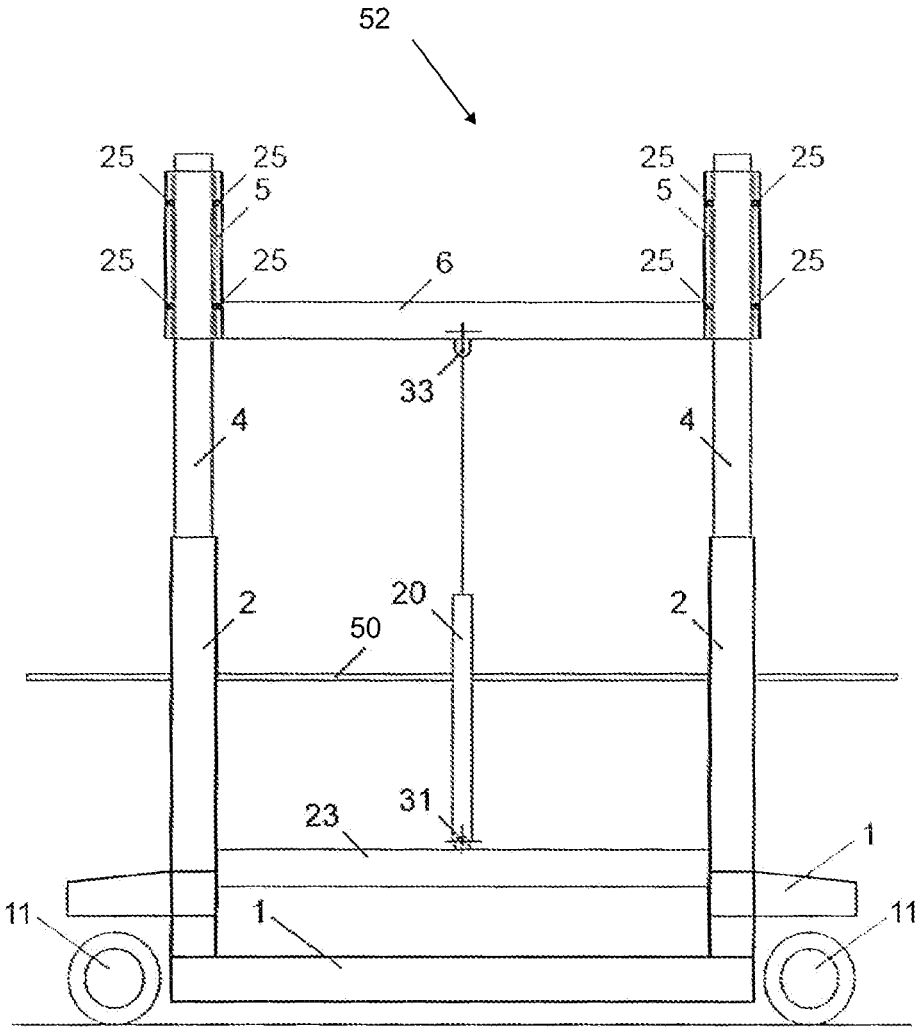
FIG. 1 is a side view of the patient transport vehicle.

1 lower chassis
2 tower
3 column
4 inner section
5 lift cart box
6 lift cart crossbar
7 swing mechanism bracket
8 swing arm
9 bushings
10 arm hole
11 wheel
12 bracket bar/pipe
13 arm bar/pipe
14 hanger
15 notch
16 hanger hole
17 not used
18 patient support pad
19 hanger bar
20 lift cart actuator
21 swing mechanism actuator
22 not used
23 tower crossbar
24 not used
25 linear bearings
26-30 not used
31 lower chassis fixation device
32 not used
33 lift cart fixation device
34 lift cart anchor
35 swing mechanism anchor
36-49 not used
50 patient transport vehicle bed
51 pad
52 lift cart assembly
53 swing/swing mechanism
54 stretcher assembly
55 hospital bed
56 surgery table
57 controller
58 actuator arm

DETAILED DESCRIPTION

A patient transport vehicle is disclosed for lifting a hospitalized patient, usually in supine position, and placing the patient on a stretcher (54). The patient transport vehicle allows transport through a hospital with the ability to transfer the patient to a work table, of the type used at diagnostic services, or to an operating table (56), or its equivalent. The can be done without demand of effort for the medic al assistant who transports the vehicle with patient. The patient transport vehicle is configured with a lower chassis (1) mounted over wheels (11), on which a stretcher assembly (54), a lift cart (52) and a swing assembly (53) are supported.

The lower chassis (1) includes a pair of lower chassis crossbars joined by a vertical tower cross bar (23) defining a lower rectangular structure with width and length such as the one of a conventional hospital stretcher. A pair of columns (3) are mounted on the lower chassis and support a patient transport bed. A pair of vertical towers (2) are supported on the lower chassis and, joined together by a vertical tower crossbar (23). Extending from the vertical towers (2) is a lift cart (52) comprised of two robust lift cart boxes (5) that slide along bearings (25) on an inner section of each tower. The square lift cart boxes (5) are joined together by the structural lift cart crossbar (6) with fixed swing mechanism brackets (7) projecting over the stretcher assembly (54).

The swing assembly (53) comprises two incurved swing arms (8) that are articulately linked to the swing mechanism brackets (7) of the lift cart, and are joined together through a longitudinal bracket pipe (12) and a longitudinal arm pipe (13). The incurved arms include a third incurved actuator arm (58) is placed equidistant between the two swing arms (8) and serves as anchor to the swing mechanism actuator cylinder (21) at its swing mechanism anchor point (35).

Figure 2:
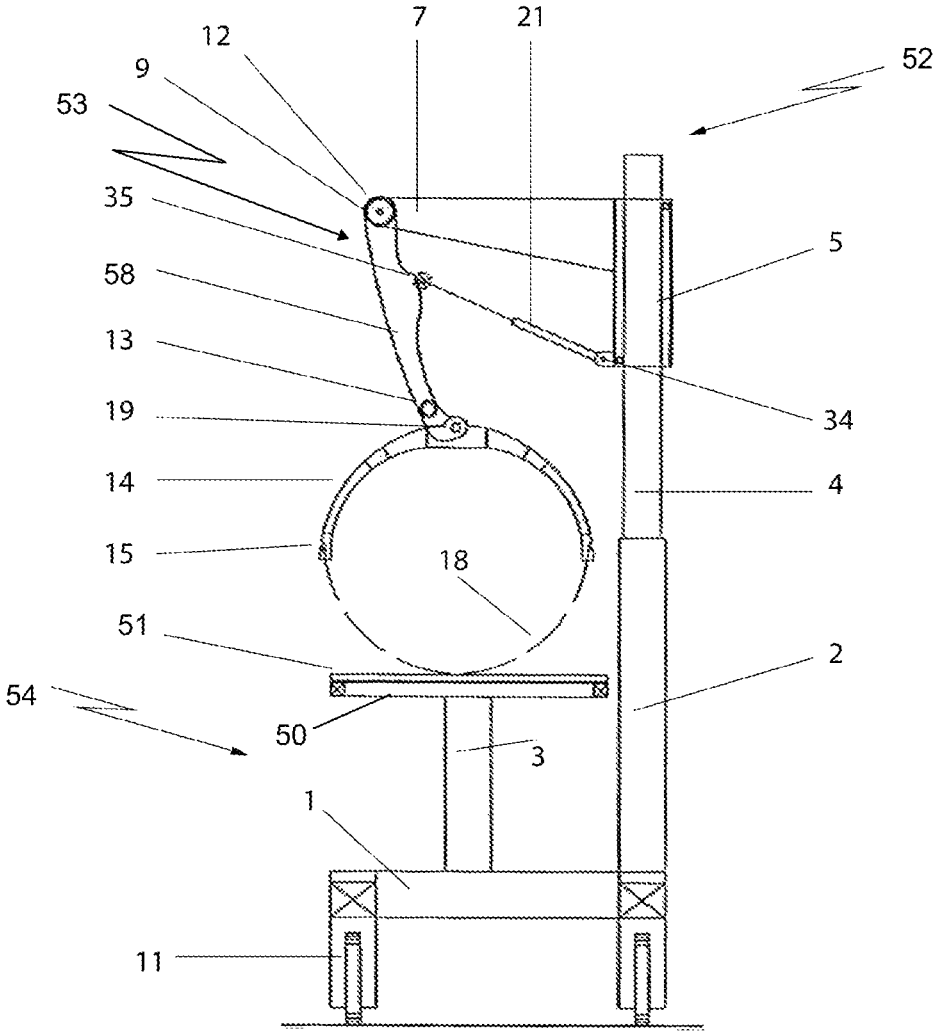
FIG. 2 is a front view of the vehicle shown in FIG. 1.
Figure 8:
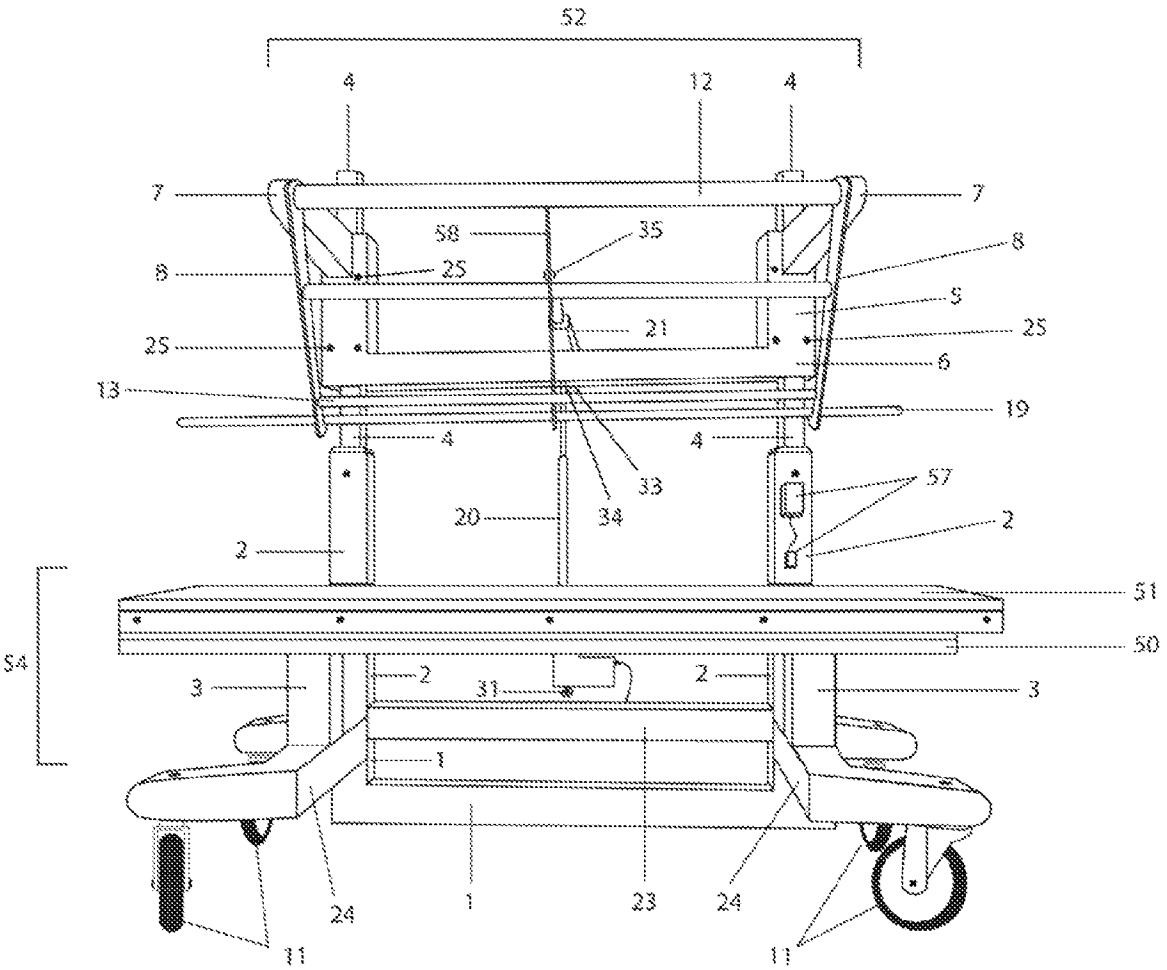
FIG. 8 is a side view of the patient transport vehicle from the opposite side of FIG. 1.

The swing assembly (53) includes a plurality of arched bars that constitute the hangers (14) which hang from a hanger tube/bar (19) threaded in the arm holes (10) defined on the free ends of each incurved arm (8 and (58). Each hanger (14) comprises an arch with a circumference with a midpoint that includes a corresponding hanger hole (16) provided for its bascule mounting on the hanger bar (19). Each of the hangers (14) includes a notch or groove (15) at 45° created for attaching a bed pad (18) with a patient. As it can be appreciated in FIGS. 1, 2 and 8, the vehicle for transporting and moving patients referred to in the present invention, is constituted from a lower chassis (1) mounted on wheels (11), including a pair of crossbars joined by rungs in a manner that a lower rectangular structure is defined which width and length is essentially the same size as a conventional hospital allowing it to be moved in the interior of the health center, without inconvenience.

As shown on the figures, the lower chassis (1) forms a fixed stretcher frame which includes a pair of vertical towers (2) joined to each other by the crossbar (23)) on the lower chassis (1). Each tower (2) houses an inner section (4) which is designed to be raised out of the (tower (2) as warranted. Columns 3 are mounted crossbars (24) on the lower chassis. Columns (3) rigidly support the patient transport vehicle bed (50) and a preferably included pad (51).

It is clear that a strong structure is configured which has the load perfectly distributed, ensuring a great stability not only during transporting, but also when placing and transferring patients.

Mounted on the towers (2) is the lift cart (52) including two rigid boxes (5) which are mounted on the inner sections (4) of both towers, and include displacement linear bearings (25). The two lift cart boxes (5) are joined to each other by the structural left cart crossbar (6). A fixed swing mechanism bracket (7) extends from each lift cart box (5) on each inner section (4) over the patient transport vehicle bed (50). The swing mechanism brackets (7) are parallel to each other.

The lift cart (52) is raised and lowered by an electro mechanical lift cart actuator (20) which is attached to a lower chassis fixation device (31) attached to the lower chassis crossbar (23) at one end of the actuator. The opposite end of the lift cart actuator (20) is attached to a lift cart fixation device (33) attached to the lift cart crossbar (6). The actuator is controlled by an electric controller (57) capable of command via remote control.

As it is shown on the Figures said lift cart (52) includes a swing mechanism (53) designed to carry out the transfer tasks of the patient from and onto the patient transport vehicle bed (50) on the patient transport vehicle.

Figure 4:
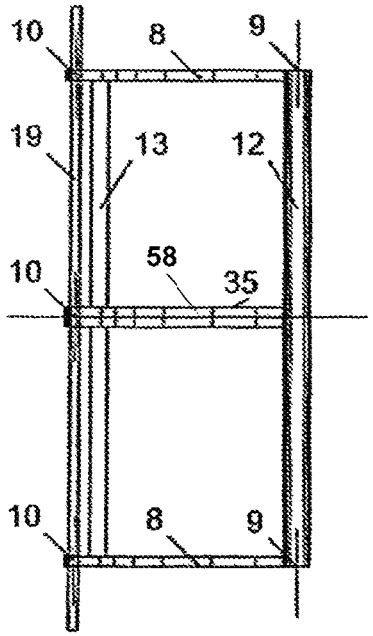
FIG. 4 is a detail of a top view of the lift cart and stretcher assembly.
Figure 9:
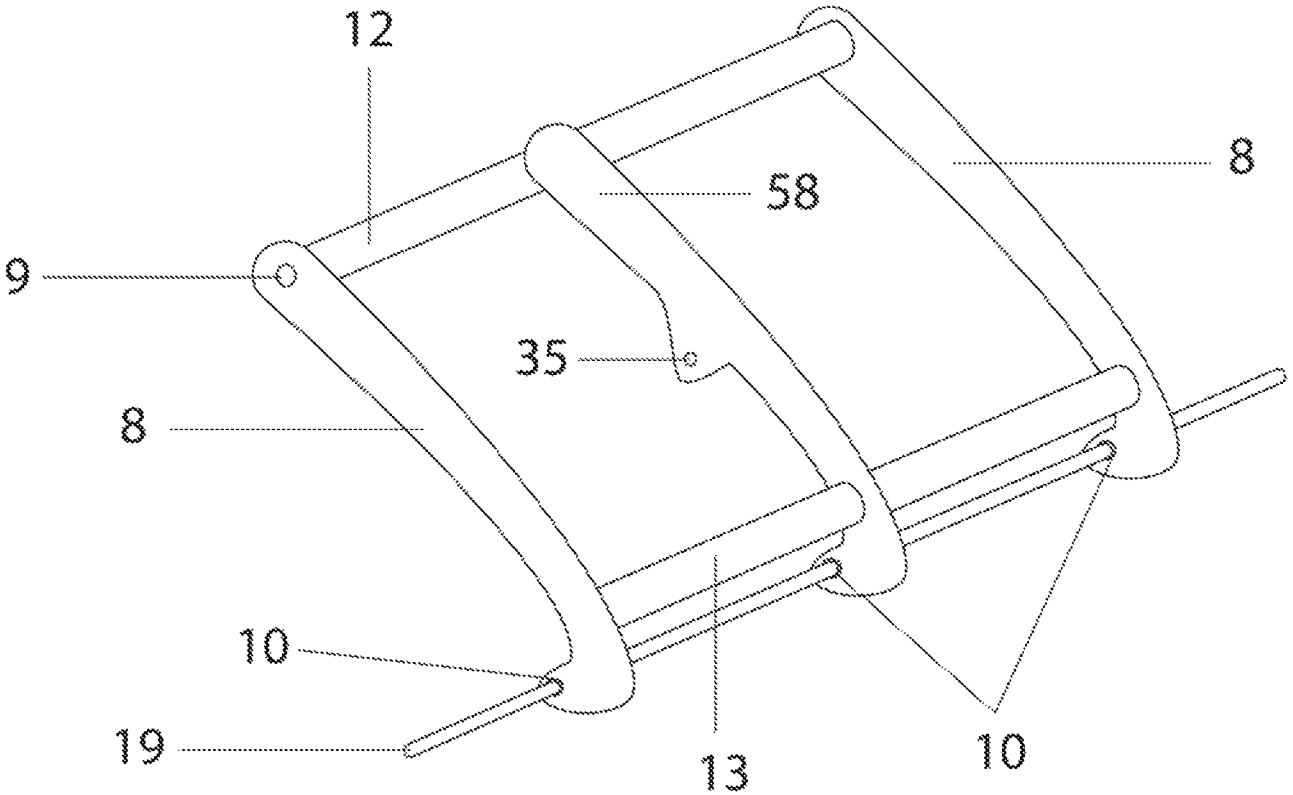
FIG. 9 is a perspective view of FIG. 4.

FIGS. 4 and 9 depict the swing mechanism (53) which includes swing arms (8) mounted at one end with a bushing (9) on a bracket pipe (12) in the location of the arm pipe passing through the swing mechanism bracket (7). The swing arms (8) are connected to each other by the bracket pipe (12) at one end of each arm and by an arm pipe (13) near the opposite end of each swing arm (8). A third arm is an actuator arm (58) which is connected to pipes (12) and (13) and is located equidistant from the two swing arms. The pipes (12) and (13) are secured to each arm (8) and (58).

The angular movements for the transversal displacements of this swing mechanism (53) are executed by the electro mechanic swing mechanism actuator (21) which extends from a lift cart anchor (34) on the crossbar 6 of the lift cart (52), to a swing mechanism anchor (35) attached at an intermediate point of the actuator arm (58).

This actuator is connected to an electronic circuit that includes a means of command via remote control (57).

Both actuators (20) and (21) can be dynamic fluid cylinders, pneumatic or any other means equivalent capable of carrying out the mentioned displacements. The actuators are actuated through electric devices. In one embodiment the electric circuit is fed by rechargeable batteries and include controls for remote command, which are not described because they are known and do not affect the scope of this invention.

As it was previously explained, the swing mechanism (53) hangs from the lift cart, and includes a plurality of hangers (14) that hang from a rigid hanger bar/tube (19) threaded in the arm holes (10) defined in the free ends of each arm (8) and (58).

The disclosed hanger bar (19) confers to the medical assistant the possibility of choosing the number of hangers to be used in every case, which, undoubtedly, is in function to the physical size of each patient.

Figure 3:
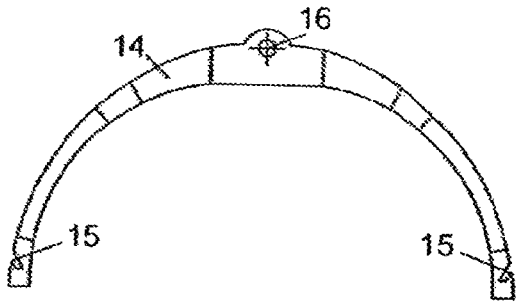
FIG. 3 is a detail, on a side view of a hanger.

As it is particularly shown in FIG. 3, in preferred embodiments, each hanger (14) comprises an arch with circumference with a midpoint that includes a corresponding hanger hole (16) provided for its bascule mounting on the hanger bar (19) (FIG. 4). Each hanger includes on its free ends on the external side and at a 45° angle a notch configured to clasp the patient support pad (18) (the patient support pad is represented with a broken line on the figures).

Figure 5:
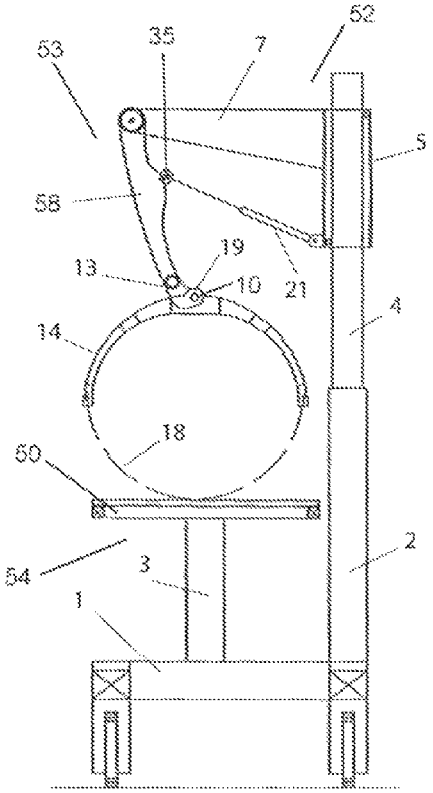
FIG. 5 is a side view of the patient transport vehicle in a position for lifting a patient.
Figure 6:
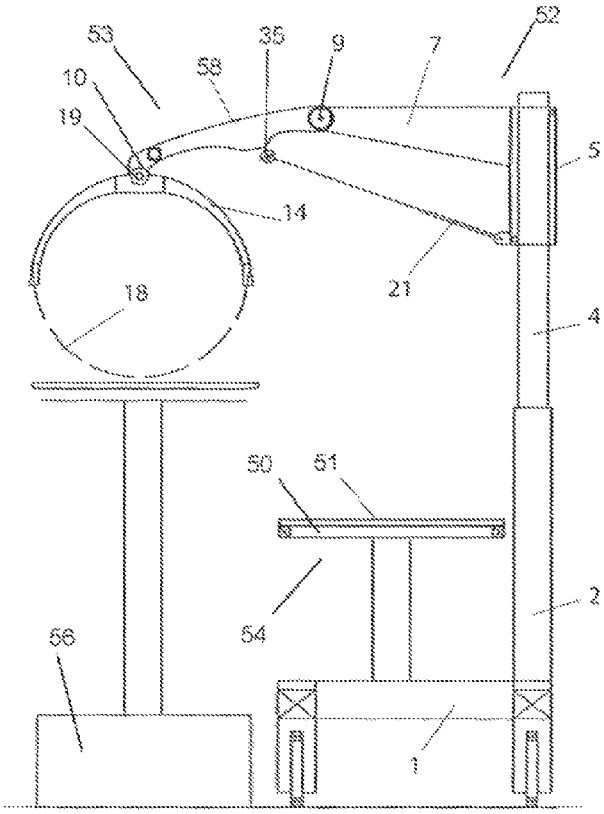
FIG. 6 is a side view of the patient transport vehicle in a position to place the patient on an operating table.
Figure 7:
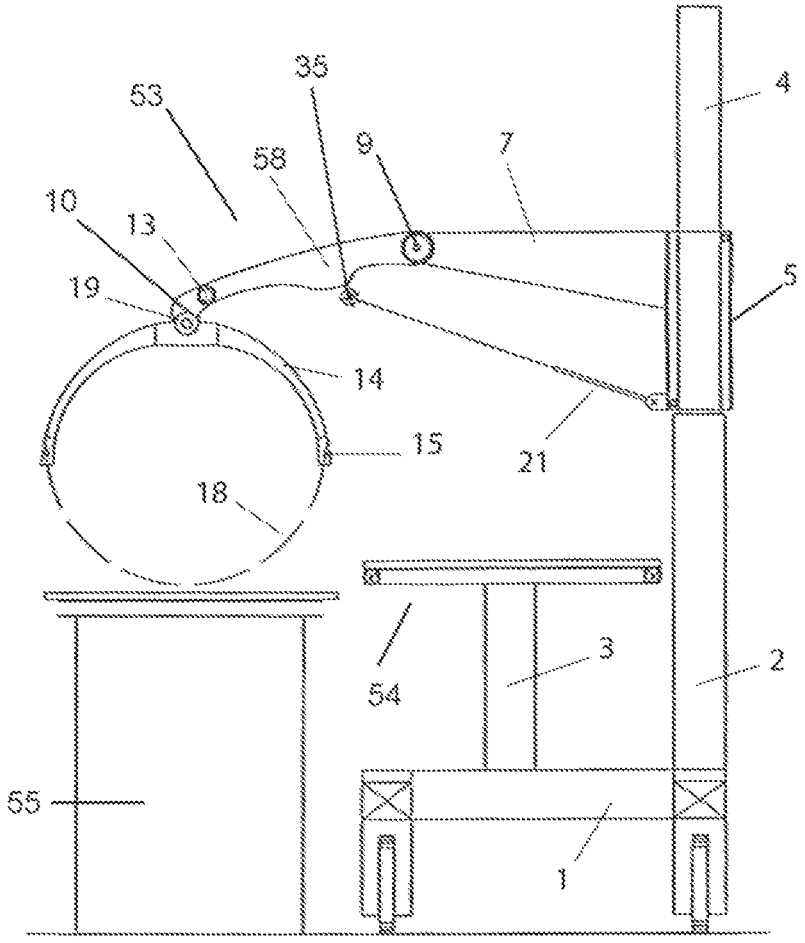
FIG. 7 is a side view of the patient transport vehicle in a position to place the patient on a bed.

As disclosed and as is especially represented in FIGS. 5 to 7, it is possible to understand that it is about a strong vehicle and maneuverability capable of moving smoothly and silently along hospital floors and going through openings and entrance doors to rooms, entering elevators and moving comfortably along the halls of the hospital, keeping the patient stable and contained by the patient support pad (18) while lying or resting on the patient transport vehicle bed (50).

To perform the transfer tasks the actuators (20) and (21) are used and they could be pneumatic cylinders or the equivalent. With the cylinder lift cart actuator (20) the lift cart (A) is displaced, while with the swing mechanism actuator (21) transversal movements of the swing (53) are produced, necessary for the lateral transfers.

A summary of one embodiment is a patient transport vehicle including a lower chassis (1) with two or more wheels (11) on a bottom of the lower chassis and a bed (50) supported by two columns (3) mounted on the lower chassis. Two towers (2) are mounted on the lower chassis with a tower crossbar (23) between the two towers (2). A lift cart assembly (52) supported by the two towers (2) includes an inner section (4) in each of the two towers which is configured to be able to raise out from a top of the two towers with a lift cart box (5) mounted on the inner section (4) of each tower (2) and with a lift cart crossbar (6) attached to each box (5) and extending between the boxes.

A lift cart actuator (20) with one end mounted on the tower crossbar (23) is attached to the lift cart crossbar (6) at an opposite end. A swing mechanism is configured with two brackets (7) extending over the bed (50). Each bracket (7) is attached to one of the boxes (5) and a bracket pipe/bar (12) extends between each bracket and passes through an opposite end of each bracket. Two swing arms (8) with a bushing (9) at one end are mounted on the bracket pipe (12). An actuator arm (58) is positioned in between the two swing arms (8) and an arm bar (13) is threaded through each swing arm (8) and actuator arm (58). A swing mechanism actuator (21) is mounted with one end mounted on the lift cart crossbar (6) and attached to the actuator arm (58) at an opposite end. Two or more hangers (14) are mounted on the arm bar (13).

Utilizing the disclosed patient transport vehicle when the patient is in a hospital bed (55) on a patient support pad (18), the medical assistant can then proceed as follows:

1. As is shown in FIG. 7, the lift cart (52) descends and the swing mechanism (53) is moved to the outside to position the hangers (14) over the hospital bed (55) in such a way to allow the medical support person to place the perimeter clasps on the patient support pad (18) onto the notches (15) on each hanger (14).
2. Once the patient is properly positioned on the patient support pad (18), the medical support person, using the remote control, commands the rising of the lift cart (52) lifting the patient.
3. Then as it is shown in FIG. 5, the same medical support person, using the remote control, laterally moves the swing mechanism (53) until the patient is properly positioned on the stretcher assembly (54) of the patient transport vehicle;
4. With the patient properly on the patient transport vehicle bed (50) and contained by the patient support pad (18) which is still connected to the set of hangers (14), the patient can be transported to a desired location.
5. FIG. 6 shows the case where the patient is transferred to a surgery table (56) which usually is higher than the patient transport vehicle bed (50). The medical assistant can then using the remote control, control the lifting and lateral displacement maneuver until the patient is set on the surgery table (56).

We are in condition to ensure that the assembly in its plurality of all the constitutive parts of the vehicle when actuated from the command conform a system that integrates movements and displacements with respect to the patient especially ideal for logistics of hospital wards.

The above is a detailed description of particular embodiments of the invention. It is recognized that departures from the disclosed embodiments may be made within the scope of the invention and that obvious modifications will occur to a person skilled in the art. Those of skill in the art should, in light of the present disclosure, appreciate that many changes can be made in the specific embodiments which are disclosed herein and still obtain a like or similar result without departing from the spirit and scope of the invention. All of the embodiments disclosed and claimed herein can be made and executed without undue experimentation in light of the present disclosure.

I claim:

1. A patient transport vehicle comprising:

a lower chassis;

two or more wheels on a bottom of the lower chassis;

a bed supported by two columns mounted on the lower chassis;

two towers mounted on the lower chassis with a tower crossbar between the two towers;

a lift cart assembly supported by the two towers and including an inner section in each of the two towers configured to be able to raise out from a top of the two towers and a box mounted on the inner section of each tower with a lift cart crossbar attached to each box and extending between the boxes; and a swing mechanism including two brackets extending over the bed with one end of the each bracket attached to one of the boxes and a bracket pipe extending between and passing through an opposite end of each bracket; two swing arms with a bushing at one end mounted on the bracket pipe; an actuator arm positioned in between the two swing arms; a hanger bar threaded through each swing arm and actuator arm; and two or more hangers mounted on the hanger bar.

2. The patient transport vehicle according to claim 1 further comprising a lift cart actuator with one end mounted on the tower crossbar and attached to the lift cart crossbar at an opposite end.

3. The patient transport vehicle according to claim 2 further comprising a swing mechanism actuator with one end mounted on the lift cart crossbar and attached to the actuator arm at an opposite end.

4. The patient transport vehicle according to claim 3 further comprising a patient support pad and one or more additional hangers mounted on the hanger bar and each hanger including a notch for clasping the patient support pad.

5. The patient transport vehicle according to claim 3 further comprising a controller for the lift cart actuator and the swing mechanism actuator.

6. The patient transport vehicle according to claim 5 in which the controller is configured to allow remote control.

7. The patient transport vehicle according to claim 5 further comprising a patient support pad.

8. The patient transport vehicle according to claim 7 further comprising one or more additional hangers mounted on the hanger bar and each hanger including a notch for clasping the patient support pad.

9. The patient transport vehicle according to claim 8 wherein each hanger is configured in a semi-circumferential arc.

10. The patient transport vehicle according to claim 9 wherein each hanger is further configured with a midpoint that includes a corresponding hanger hole provided for bascule mounting on the hanger bar.

11. The patient transport vehicle according to claim 1 further comprising bearings on the inner section of each of the two towers on which the box mounted on each inner section slides.

* * * * *